United States Patent [19]

Graillat

[11] Patent Number: 4,768,805

[45] Date of Patent: Sep. 6, 1988

[54] META BINDING

[75] Inventor: Gerard Graillat, Annecy, France

[73] Assignee: Salomon S. A., Annecy Cedex, France

[21] Appl. No.: 27,972

[22] Filed: Mar. 19, 1987

[30] Foreign Application Priority Data

Mar. 19, 1986 [FR] France ..... 86 03921

[51] Int. Cl.[4] ..... A63C 9/18

[52] U.S. Cl. ..... 280/615

[58] Field of Search ..... 280/613, 614, 615

[56] References Cited

U.S. PATENT DOCUMENTS

| | | | |
|---|---|---|---|
| 2,693,967 | 11/1954 | Jones, Jr. | 280/613 |
| 3,838,866 | 10/1974 | D'Alessio et al. | 280/613 X |
| 4,032,172 | 6/1977 | Pyzel et al. | 280/615 |
| 4,353,574 | 10/1982 | Faulin | 280/613 |
| 4,418,937 | 12/1983 | Salomon | 280/613 |

FOREIGN PATENT DOCUMENTS

| | | | |
|---|---|---|---|
| 7723934 | 8/1977 | Fed. Rep. of Germany . | |
| 2907365 | 2/1979 | Fed. Rep. of Germany . | |
| 2846475 | 5/1980 | Fed. Rep. of Germany | 280/615 |
| 3310739 | 3/1983 | Fed. Rep. of Germany . | |

*Primary Examiner*—John J. Love
*Assistant Examiner*—Michael Mar
*Attorney, Agent, or Firm*—Pollock, Vande Sande & Priddy

[57] ABSTRACT

A system comprising a cross country ski boot and a device for fastening the front of the boot to a ski. The holding device holds the front part (15*a*) of the sole (15) of the boot flat on the upper part of the ski in a front holding area up to a rear limit thereof located substantially under the metatarsal-phalangeal joint area (A) of the skier's foot, and comprises bindings (4) exerting a longitudinal stress on the front end of the boot, and at least one fastening block (5) attached to the ski rearwardly of the bindings (4).

6 Claims, 4 Drawing Sheets

META BINDING

FIELD OF THE INVENTION

The present invention relates to an assembly comprised of a cross country ski boot and a device for fastening the front of this boot to a ski, the device leaving the heel free to be raised during skiing.

BACKGROUND OF THE INVENTION

Known systems of this type generally permit the release of the boot from the ski, or they permit only partial freedom of movement in the lateral or vertical direction, when falling forward or backward with respect to the ski, but without detachment from the latter. Exemplary in this respect are the systems described in German Pat. No. 2,907,365, German Utility Model 7 723 934, and German Pat. No. 3,310,739. In all of these disclosures, the partial or total release of the boot occurs between the holding elements, properly speaking, of the boot and an elastic locking device with which they cooperate.

SUMMARY OF THE INVENTION

An object of this invention is to simplify this type of boot/binding system by eliminating any intermediary holding element between the boot and the elastic locking device.

For this purpose, this system comprised of a cross country ski boot and a device to hold the front of this boot on a corresponding ski, with this device making it possible to raise the heel of the boot, is characterized in that it comprises means to hold the front part of the sole of the boot flat against the upper part of the ski in a holding zone extending between the front end of the sole and the rear limit thereof located substantially under the metatarsal-phalangeal joint area of the skier's foot, these holding means comprising bindings exerting longitudinal stress on the front end of the boot and at least one fastening block attached to the ski behind means producing the longitudinal stress and against which is applied a support part of the sole located at the rear limit of the front part of the boot, which is kept pressed in a rigid manner against the ski under the effect of this longitudinal stress.

The longitudinal stress may be exerted towards the rear of the ski, in which case the support part of the sole is pushed back against a front surface of the fastening block or blocks.

According to one embodiment, the longitudinal stress may also be exerted forward, and in this case the support part of the sole is pulled against a rear surface of the fastening block.

BRIEF DESCRIPTION OF THE DRAWINGS

Various embodiments of the invention are described below on a non-limitative basis, with reference to the attached drawings, in which.

DETAILED DESCRIPTION

Figure 1:
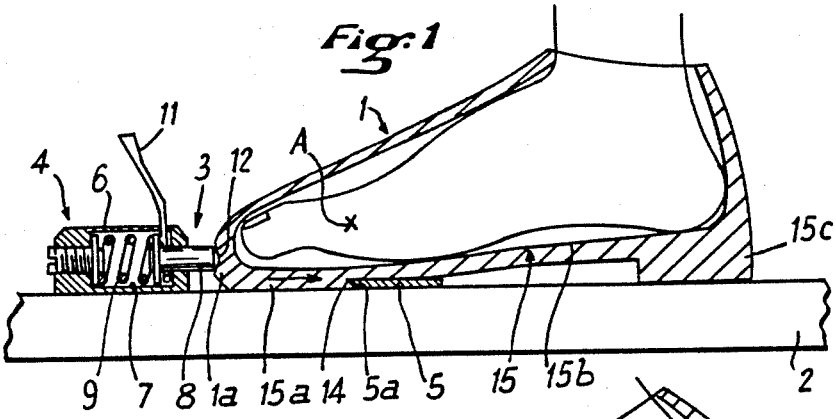
FIG. 1 is a vertical and longitudinal cross section of a boot-binding system according to the invention, with the entire boot being applied flat against the ski.
Figure 2:
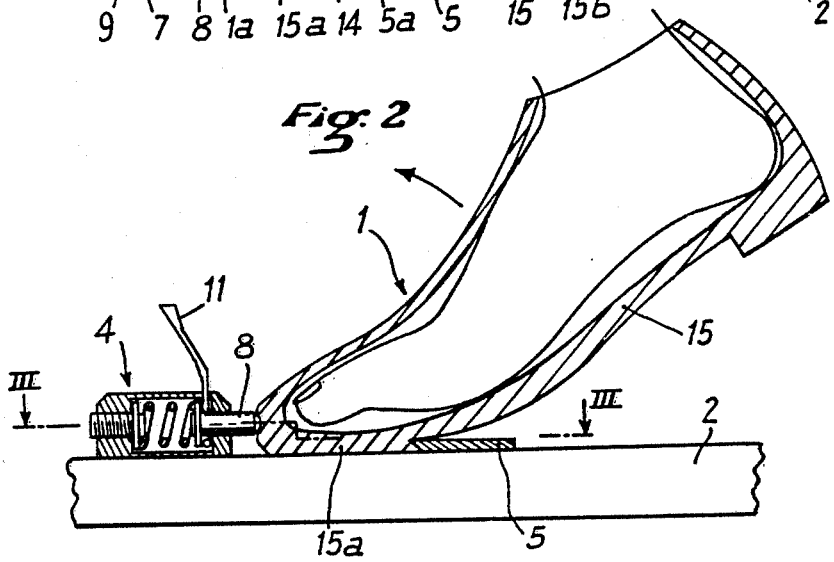
FIG. 2 is a vertical and longitudinal cross section of the boot-binding system in FIG. 1, with the boot being shown during the rolling of the foot, with the heel raised.
Figure 3:
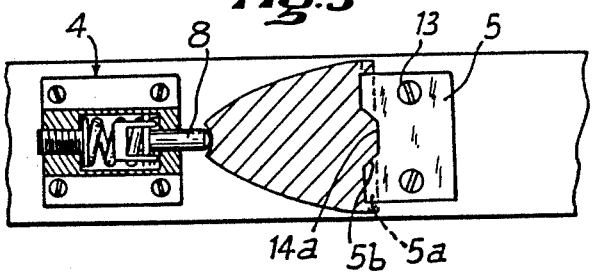
FIG. 3 is a horizontal cross section view along line III—III in FIG. 2.

The boot/binding system according to the invention, which is shown in FIGS. 1 to 3, is intended to hole a cross country ski 1 on a corresponding ski 2 using a holding device 3. This elastic locking-type holding device comprises two elements attached to the upper surface of the ski, namely, front binding means 4 and a rear fastening and holding block 5. The front binding means 4 comprise a collet 6 having an internal longitudinal housing 7 in which a locking tappet 8 is mounted in a sliding manner, projecting towards the rear. This locking tappet 8 is biased towards the rear by a spring 9 placed in the longitudinal housing 7. The locking tappet 8 can be pushed towards the front by a lever 11 placed on the collet 6 and coupled to the locking tappet 8 inside the collet 6. The locking tappet 8 engages in a corresponding depression 12 provided in the front end part of the boot 1.

The rear fastening block 5 which is attached to the ski by screws 13 (see FIG. 3), has a front transverse surface 5*a* inclined from bottom to top and rear to front and against which is applied a corresponding transverse surface 14 provided in the sole 15 of the boot 1. This sole 15 comprises the front holding part 15*a* limited towards the rear by the transverse support surface 14 and extended towards the rear by an intermediary part 15*b*, located under the plantar arch and connected to the heel 15*c*.

From the preceding description, it will be understood that the front part 15*a* of the sole 15 is immobilized flat on the upper part of the ski 2 between the front binding 4 and the rear fastening block 5. This front part 15*a* of the sole 15 extends over a distance in a longitudinal direction so that its rear limit, constituted by its inclined transverse surface 14 by which it presses against the front surface of the rear fastening block 5, is located substantially under the metatarsal-phalangeal joint area of the skier's foot. In other words, the front holding part 15*a* of the sole 15 extends to the rear until it reaches a rear limit located under the metatarsal-phalangeal joint indicated by A in FIG. 1, and this rear limit is constituted by the rear support surface 14 of the sole 15.

Because only the front part 15*a* of the sole 15 is held firmly flat against the ski, all the rest of the sole and consequently the boot can bend freely, to allow the foot to roll back and forth during cross country skiing.

The front bindings 4 having elastic locking make it possible to release the boot in case the skier falls forward or stress dangerous for the skier is applied to the boot. Indeed, when the skier falls forward, for example, the boot pivots in the counterclockwise direction (by the arrow in FIG. 2) about the end of the locking tappet 8, while being raised off the rear fastening block 5. This raising is made possible by the relative sliding of the rear support surface 14 of the sole against the anterior frontal surface 5*a* of the fastening block 5 against the effects of the elastic thrust of the front device 4. After the front part 15*a* of the sole is raised sufficiently, the latter can escape totally from the holding device 3 comprised of the front binding means 4 and the rear fastening block 5.

The rear fastening block 5 can be made in different ways. In the embodiment shown in FIG. 3, the inclined front surface 5*a* of the fastening block 5 which could be continuous over its entire length, has in its central part a depression 5*b* into which a boss 14*a* issuing from the rear support surface 14 of the sole projects.

Figure 5:
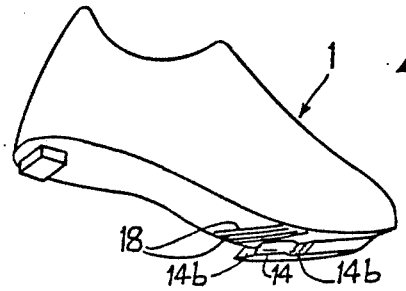
FIG. 5 is a perspective view of a boot adapted for a use in the system shown in FIG. 1.
Figure 4:
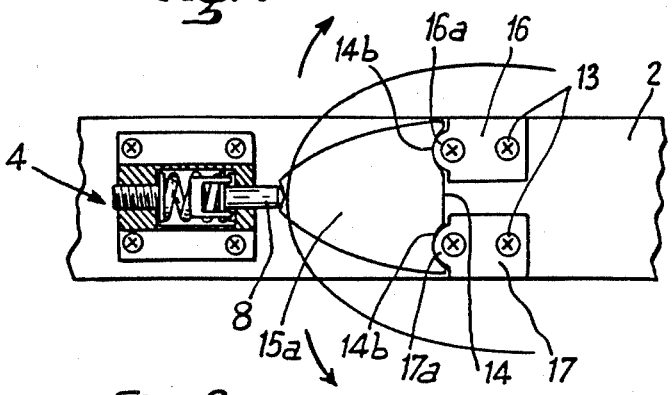
FIG. 4 is a partial schematic plan view of the boot/-binding device in FIG. 1.

In the embodiment of the invention shown in FIG. 4, the rear support surface 14 of the sole 15 is pushed back by the locking tappet 8 against two fastening blocks 16, 17 attached to the ski by screws 13. These fastening blocks 16, 17 have on their respective front surfaces support bosses 16*a*, 17*a* which are engaged in corresponding depressions 14*b* placed in the rear support surface 14 of the sole. This sole is advantageously provided immediately behind the rear support surface 14, with transverse grooves 18 (FIG. 5) or low-resistance lines which facilitate the flexion of the boot in this zone.

In the embodiments of the invention described thus far, the front surface(s) of the fastening block(s) 5, 16, 17 extend in a perpendicular manner to the longitudinal axis of the ski. Especially, the bosses 16*a*, 17*a* of the two fastening blocks 16, 17 are aligned transversely and cooperate with a rear support surface 14 of the sole 15 which is perpendicular to the longitudinal axis of the ski.

Figure 6:
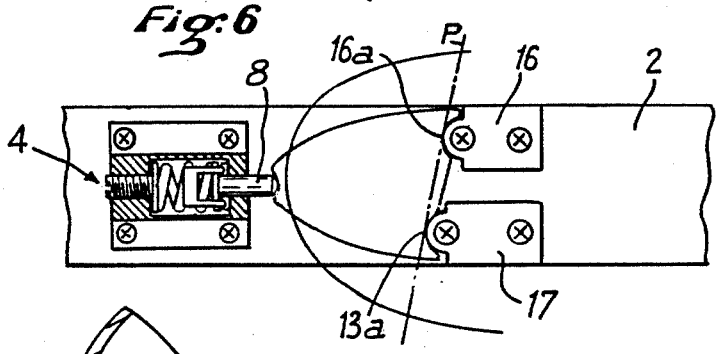
FIG. 6 is a schematic partial plan view of one embodiment.

In the embodiment of the invention shown in FIG. 6, the two front bosses 16*a*, 17*a* of the respective fastening blocks 16, 17 against which the front part 15*a* of the sole 15 is pressed, are offset longitudinally with respect to each other. More specifically, the boss 16*a* of the fastening block 16 located on the outside of the ski is offset to the rear with respect to the boss 17*a* on the other fastening block 17, located on the inside of the ski, so as to form a contact between the front part 15*a* of the sole and the fastening blocks 16, 17, in a plane P which is inclined with respect to the longitudinal axis and which is parallel to the axis of the metatarsal-phalangeal joint A.

Figure 7:
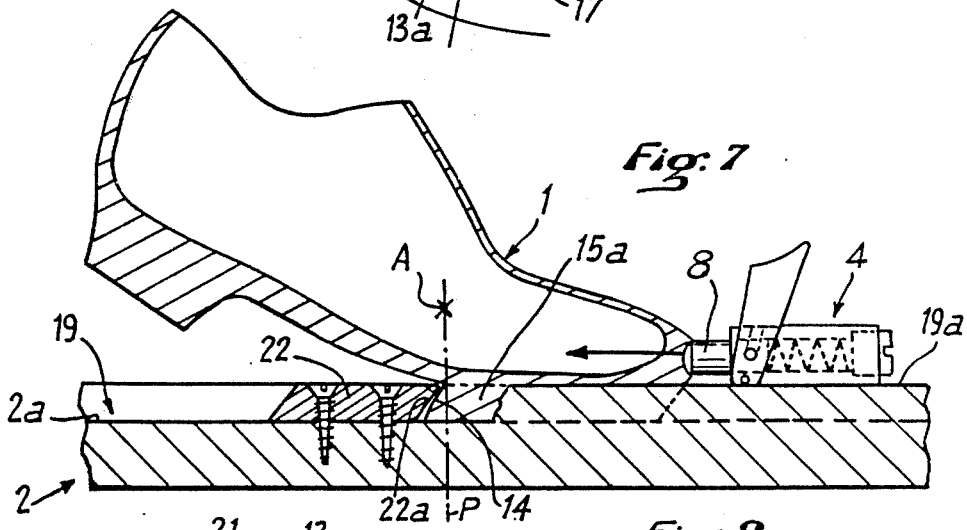
FIG. 7 is a vertical and longitudinal cross section along line VII—VII in FIG. 8, of another embodiment adapted to a ski having a longitudinal guiding and centering rib on its upper surface, with the heel of the boot being shown in raised position.
Figure 8:
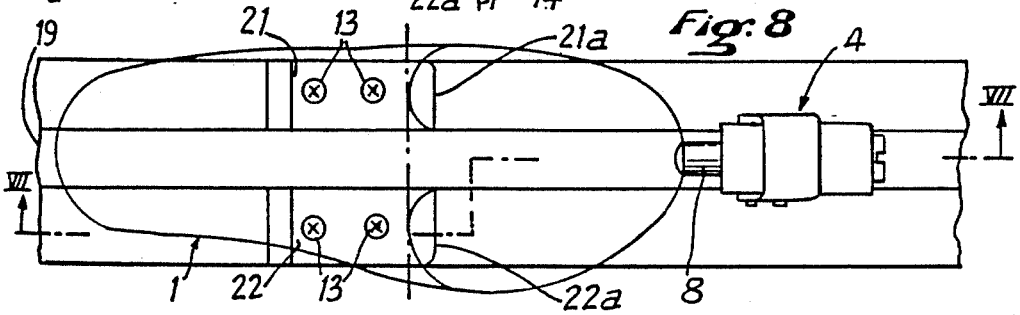
FIG. 8 is a schematic plan view of the system in FIG. 7.

FIGS. 1 to 6 illustrate the application of the invention to a ski having a flat upper surface. FIGS. 7 and 8 illustrate an adaptation of the invention to a ski 2 having on its upper surface 2*a* a longitudinal guiding and centering rib 19 which can either be unitary with the ski or comprise an element mounted thereon. In this case, the front bindings 4 ensuring the elastic locking can be mounted on the upper surface 19*a* of the rib 19, which preferably has a right trapezoidal section. Two rear fastening blocks 21, 22, respectively attached to upper surface 2*a* of the ski 2 on both sides of the central guide rib 19, cooperate with these bindings to constitute the holding device 3. These fastening blocks 21, 22 can in vertical cross section have the shape of a parallelogram defining for each of them a respective transverse front surface 21*a*, 22*a* inclined from bottom to top and from back to front to hold the front part 15*a* of the sole 15 of the boot. In this embodiment, this front part 15*a* has in its central part a longitudinal groove substantially having the same shape as the central guiding rib 29 and fitting over the latter.

The two fastening blocks 21, 22 are attached to the ski by screws 13 so that their respective front surfaces 21*a*, 22*a*, which are in contact with the rear support surface 14 of the front part 15*a* of the sole 15, are located approximately under the metatarsal-phalangeal joint area A of the skier's foot. The front surfaces 21*a*, 22*a* of the two rear fastening blocks 21, 22 are coplanar, and their common plane P extends perpendicularly to the longitudinal axis of the ski.

Figure 9:
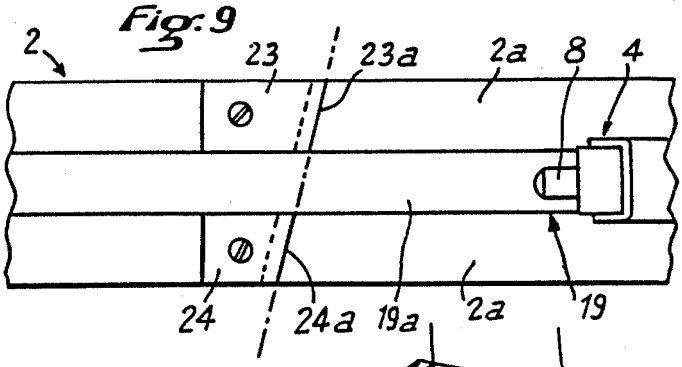
FIG. 9 is a schematic partial plan view of an embodiment of the invention illustrated in FIGS. 7 and 8.
Figure 10:
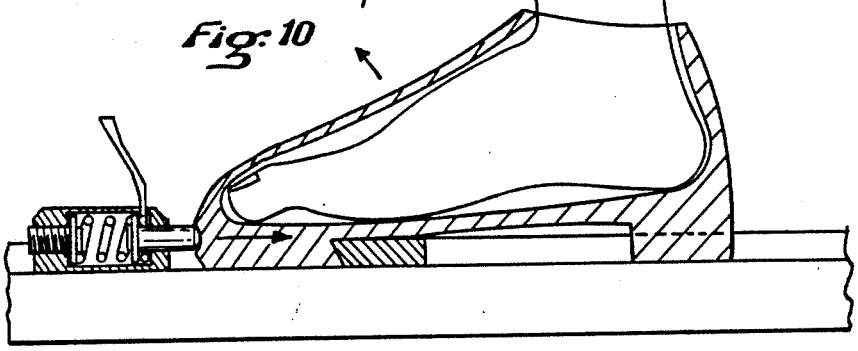
FIG. 10 is a vertical and longitudinal cross section plan view of yet another embodiment of a boot binding, with the boot being shown flat on the ski.
Figure 11:
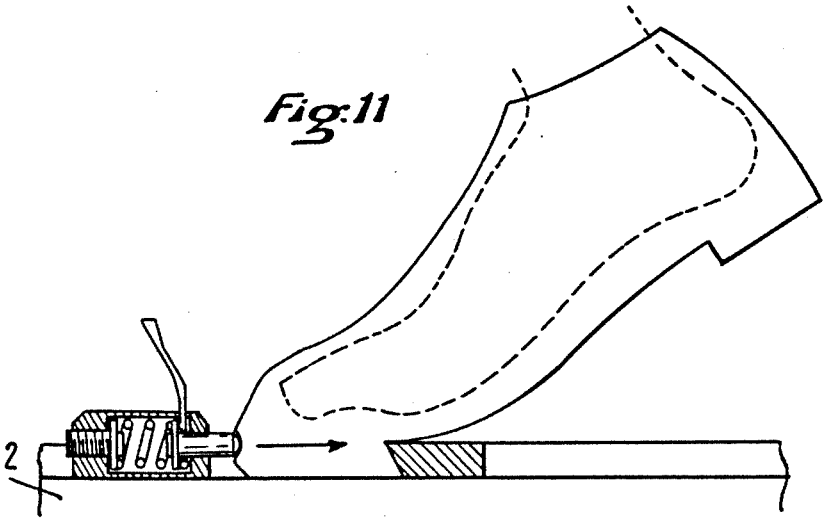
FIG. 11 is a vertical and longitudinal cross section similar to that in FIG. 11, with the heel of the boot shown in raised position.
Figure 12:
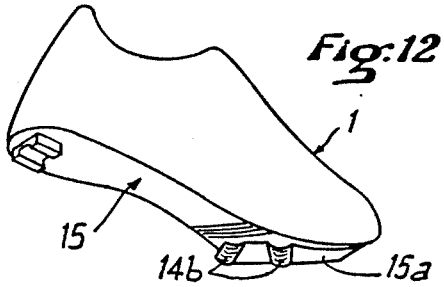
FIG. 12 is a perspective view of a boot adapted for use in the system illustrated in FIGS. 7 to 9.

The upper horizontal surfaces of the two rear fastening blocks 21, 22 can be flush with the upper horizontal surface 19*a* of the guiding rib 19, as shown in FIG. 9, or they can be located at a higher or lower level.

In FIG. 8 the flexion zone for the boot extends, as indicated above, in a direction perpendicular to the longitudinal axis of the ski. FIG. 9 shows another embodiment in which the flexion zone of the boot is inclined with respect to the longitudinal axis of the ski and substantially follows the natural flexion axis of the metatarsal-phalangeal joint A of the skier's foot. In this case, the two rear fastening blocks 23, 24, which are attached to the upper surface 2*a* of the ski on both sides of the guide rib 19, end in coplanar anterior frontal surfaces 23*a*, 24*a* which define a zone for the flexion of the boot, inclined with respect to the longitudinal axis of the ski and corresponding substantially to the zone of the metatarsal-phalangeal joint area A of the foot. Because of this incline in the zone of flexion, the anterior frontal surface 23*a* of the rear fastening block 23 located on the inner side of the ski and which is the longest is situated slightly in front of the anterior frontal surface 24*a* of the rear anchoring block 24 located on the outer side of the ski and which is shortest.

Figure 13:
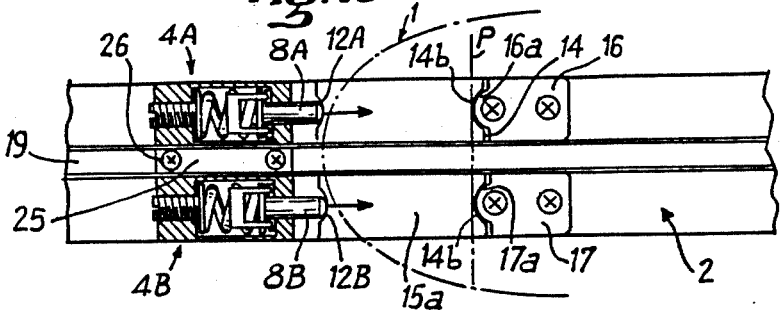
FIG. 13 is a schematic plan view of the system shown in FIG. 11.
Figure 14:
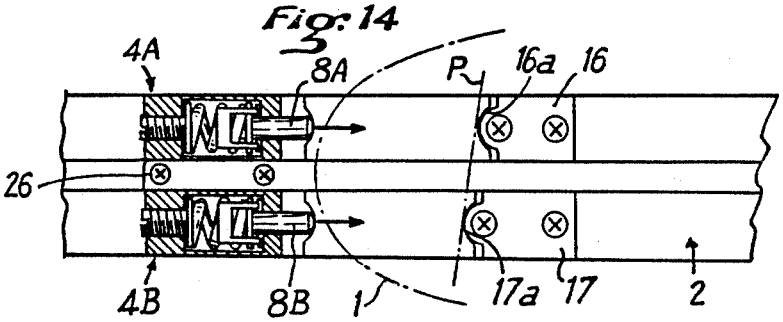
FIG. 14 is a plan view of an embodiment of the elements of the holding device attached to the ski.

In the embodiment of the invention shown in FIGS. 11 to 14, the device for holding the front of the boot comprises two front bindings 4A, 4B, similar to front binding 4, which are attached to the upper surface 2*a* of the ski 2, respectively on both sides of the central rib 19. These two front bindings 4A, 4B can form a single component and be interconnected by a central part 25 forming a bridge, the shape of which corresponds to that of the rib 19, so it can fit over the latter. The bindings are fastened by screws 26 passing through the central part 25 forming a bridge and screwed into the upper surface 19*a* of the rib 19. The respective tappets 8A, 8B of the two bindings 4A, 4B which are pushed back elastically towards the rear are engaged respectively in depressions 12A, 12B provided in the anterior frontal surface of the sole of the boot and on both sides of the guide rib 19. As in the preceding case, the front part 15*a* of the sole 15 is pressed flush by depressions 14*b* provided in its rear support surface 14 against the bosses 16*a*, 17*a* of the fastening blocks 16, 17. FIG. 13 illustrates a support plane on the bosses 16*a*, 17*a*, which is perpendicular to the longitudinal axis of the ski, while in the case illustrated in FIG. 14, this support plane is inclined with respect to the longitudinal axis so as to correspond with the axis of the metatarsal-phalangeal joint.

Figure 15:
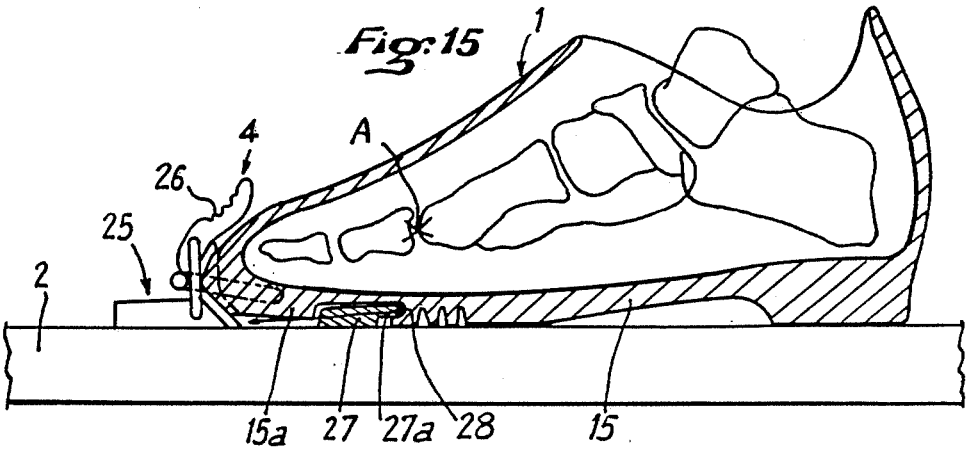
FIG. 15 is a vertical and longitudinal cross section of an embodiment of the boot/binding system in which the longitudinal stress exerted on the boot is directed forward.
Figure 16:
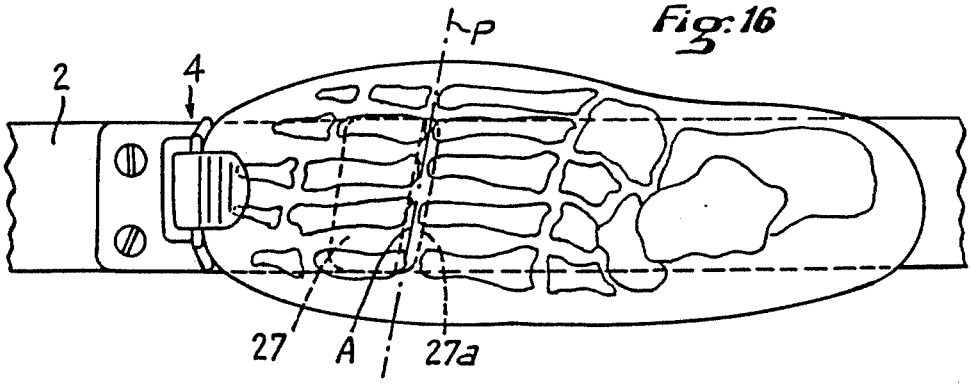
FIG. 16 is a schematic plan view of the system illustrated in FIG. 15.

In the embodiment of the invention shown in FIGS. 15 and 16, the holding device 1 comprises a conventional front binding 25 provided with a lock lever 26 pivot mounted so that it can exert forward traction on the boot. Moreover, the fastening block 27 attached to the ski behind the binding 25 comprises a rear and upper edge 27*a* which overhangs towards the rear and engages in a complementary groove 28 in the sole 15 of the boot. This rear edge 27*a* (and consequently the groove 28 in the sole) can be inclined in a horizontal plane with respect to the longitudinal axis of the ski so that it is contained in the vertical plane P passing through the metatarsal-phalangeal joint A of the skier's foot or parallel and close to this plane, or else it can be perpendicular to the longitudinal axis of the ski. The boot 1 is held in place on the ski by engaging it forward so that the groove 28 in the sole 15 fits over the edge 27*a* of the block 27, whereafter the lock lever 26 is pivoted so as to exert forward traction on the boot and thus fix the sole 15 tightly on the fastening block 27.

The holding zone for the front part 15*a* of the sole 15 can extend from the front end of the sole up to a rear limit which can at most be located at the level of the metatarsal-phalangeal joint area A of the skier's foot as described above, but also at a distance smaller than that between A and the front end of the sole.

What is claimed is:

1. System comprised of a cross country ski boot having a sole (15) and a device for fastening a front end of said boot to a ski, said device allowing a heel of said boot to be raised, and comprising front binding means (4) and rear fastening means (5) attached to an upper surface of said ski for holding an integral depending front portion (15*a*) of said sole (15) flat against an upper portion of said ski in a holding zone located between a front end of the sole (15) and a transverse surface (14) defining a rear limit thereof, said binding means (4, 25) exerting a rearwardly direction longitudinal force on said front end of said boot, said rear fastening means (5) comprising a fastening block (5; 16, 17; 21, 22; 23; 24; 27) attached to said ski rearwardly of said binding means (4, 25), said binding means (4, 25) and said rear fastening means (5) cooperating for clamping therebetween them said front portion (15*a*) of said sole, whereby a support surface (14, 28) of said sole located at said rear limit of said front portion (15*a*) of said sole is forced by the longitudinal force exerted by said binding means (4, 25) against said fastening block (5; 16, 17; 21, 22; 23; 24; 27) and said front portion (15*a*) of said sole being held rigidly pressed against said ski.

2. System according to claim 1, wherein said holding zone is located between the front end of the sole and said rear limit thereof located substantially under the metatarsal-phalangeal joint area A of the skier's foot.

3. System according to claim 1, wherein said binding means (4) exert a longitudinal force towards the rear of said ski, and said support surface (14) of said sole is pushed back against a front surface (5*a*; 16*a*, 17*a*; 21*a*–24*a*,) of said fastening block(s) (5; 16, 17; 21–24).

4. Device according to claim 3, wherein said front bindings (4) comprise a collet (6) having a longitudinal internal housing (7), a locking tappet (8) slidably mounted in said housing projecting towards the rear, and biased rearwardly by a spring (9), and a lever (11) on said collet (6) and coupled to said locking tappet (8) inside said collet (6) for biasing said locking tappet forwardly, said locking tappet (8) engaging in a corresponding depression (12) provided in said front end part (1*a*) of said boot.

5. System according to claim 3 or 4, wherein said rear fastening block (5) has a front transverse surface (5*a*), inclined from bottom to top and rear to front and against which is pressed said corresponding transverse surface (14) constituting said rear limit of said front part (15*a*) of said sole.

6. System according to claim 5, wherein said inclined front surface (5*a*) of said fastening block (5) has a depression (5*b*) in its central part, into which a boss (14*a*) issuing from said rear support surface (14) of said sole projects.

* * * * *